US009009871B2

(12) United States Patent
Shasha et al.

(10) Patent No.: US 9,009,871 B2
(45) Date of Patent: Apr. 21, 2015

(54) PROTECTIVE HEADWEAR

(71) Applicant: Aaron Shasha, Brooklyn, NY (US)

(72) Inventors: Aaron Shasha, Brooklyn, NY (US); David Conroy, Brooklyn, NY (US)

(73) Assignee: Aaron Shasha, Brooklyn, NY (US)

( * ) Notice: Subject to any disclaimer, the term of this patent is extended or adjusted under 35 U.S.C. 154(b) by 341 days.

(21) Appl. No.: 13/662,512

(22) Filed: Oct. 28, 2012

(65) Prior Publication Data

US 2013/0104296 A1 May 2, 2013

Related U.S. Application Data

(60) Provisional application No. 61/553,313, filed on Oct. 31, 2011.

(51) Int. Cl.
*A42B 3/12* (2006.01)
*A42B 1/08* (2006.01)

(52) U.S. Cl.
CPC ... *A42B 1/08* (2013.01); *A42B 3/12* (2013.01); *A42B 3/124* (2013.01)

(58) Field of Classification Search
CPC ..... A42B 1/08; A42B 3/12; A42B 3/124
USPC ..... 2/414, 411, 410, 425, 209.13, 181, 2/181.2, 181.4, 181.8, 209.11, 2, 9.12, 2/175.1, 175.4, 195.1, 195.5, 6.2, 417, 2/418, 422
See application file for complete search history.

(56) References Cited

U.S. PATENT DOCUMENTS

| | | | | |
|---|---|---|---|---|
| 1,501,507 | A | 7/1924 | Wetherbee | |
| 2,740,567 | A | 4/1956 | Kaufman | |
| 3,551,911 | A | 1/1971 | Holden | |
| 4,100,320 | A | 7/1978 | Chisum | |
| 4,439,871 | A | 4/1984 | Plastino | |
| 5,269,026 | A | 12/1993 | McManus | |
| 5,289,591 | A | 3/1994 | Andersen | |
| 5,313,668 | A | 5/1994 | Bogan et al. | |
| 5,337,420 | A * | 8/1994 | Haysom et al. | 2/410 |
| 5,437,064 | A | 8/1995 | Hamaguchi | |
| 5,481,760 | A | 1/1996 | Wood, Jr. | |
| 5,519,895 | A | 5/1996 | Barnes, Jr. | |
| 5,657,492 | A | 8/1997 | Esposito, Jr. | |
| 5,887,289 | A * | 3/1999 | Theoret | 2/425 |
| 5,930,840 | A * | 8/1999 | Arai | 2/411 |

(Continued)

OTHER PUBLICATIONS

International Search Report and Written Opinion of the International Searching Authority mailed Mar. 20, 2014 in corresponding PCT/2013/067141.

*Primary Examiner* — Danny Worrell
*Assistant Examiner* — Khaled Annis
(74) *Attorney, Agent, or Firm* — Ostrager Chong Flaherty & Broitman P.C.

(57) ABSTRACT

A protective headwear comprising a first shell half and a second shell half coupled to each other by first and second elastic strips. The combination of first and second shell halves forms a protective cage for protecting a person's head. A plurality of pads is coupled to an inner surface of the protective cage. The pads are positioned to contact strong areas on the person's head when the protective cage is worn and to provide spacing between the cage and the person's head. A baseball cap may be coupled to an outer surface of the cage to form a lightweight, unobtrusive, and protective headwear.

20 Claims, 9 Drawing Sheets

(56) References Cited

U.S. PATENT DOCUMENTS

| | | | |
|---|---|---|---|
| 5,953,761 | A | 9/1999 | Jurga |
| 6,397,399 | B1 | 6/2002 | Lampe et al. |
| 6,401,260 | B1 | 6/2002 | Porth |
| 6,625,820 | B1 | 9/2003 | Lampe |
| 6,721,961 | B2 | 4/2004 | Park |
| 7,096,512 | B2 | 8/2006 | Blair |
| 7,107,624 | B2 | 9/2006 | Dobbie |
| 7,937,778 | B1 | 5/2011 | Norton |
| D640,422 | S | 6/2011 | Green et al. |
| 7,966,673 | B1 | 6/2011 | Gibson |
| 7,975,317 | B2 | 7/2011 | Rampell |
| D660,555 | S | 5/2012 | Stoltz |
| 8,205,272 | B2 | 6/2012 | Green et al. |
| 2004/0034903 | A1 | 2/2004 | Blair |
| 2007/0130673 | A1 | 6/2007 | Wasserkrug et al. |
| 2010/0005573 | A1* | 1/2010 | Rudd et al. ..... 2/414 |
| 2011/0307997 | A1 | 12/2011 | Blair |
| 2012/0131731 | A1 | 5/2012 | Motroni |

* cited by examiner

PROTECTIVE HEADWEAR

RELATED APPLICATION

This application claims the benefit of U.S. Provisional Patent Application No. 61/553,313 filed Oct. 31, 2011, the disclosure of which is incorporated herein by reference.

TECHNICAL FIELD

This application is directed to protective headwear, and more specifically to protective headwear for non-intrusive integration with non-protective headwear such as a baseball hat.

BACKGROUND

Protective headwear typically consists of a hard casing surrounding a wearer's head. Protective headwear varies widely, and many features, such as features for padding, sizing, comfort and aesthetics may be present and customized for specific uses.

One important application of protective headwear is headwear for use during baseball games. Batters typically wear helmets, which are generally quite large, heavy, bulky and very apparent. Batting helmets typically have a large casing that completely covers the head and ears, and is made of a hard plastic material and interior padding for comfort. Batting helmets do not have a lot of ventilation and may therefore lead to discomfort caused by a buildup of heat. Therefore, it is not desirable to wear a batting helmet for long periods of time, or to where such a helmet while performing in other parts of a baseball game.

Position players, pitchers and coaches on the field typically wear baseball hats with no protective padding or other features, and therefore are not protected against being hit in the head with a baseball or bat. Pitchers are one of the closest fielders to the batter and are often in the path of fast line drive balls hit directly toward the pitcher, often while they are off-balance. First and third base coaches are also often in the direct line of a hard-hit foul ball. Position players also have the need for head protection during various aspects of a game.

Baseball head injuries are fairly uncommon, but tend to have a specific and limited nature, and can be very traumatic. For example, when a pitched ball is hit and the line-drive goes directly back to the pitcher, the ball can travel at speeds of up to 130 miles per hour, giving the pitcher a very short amount of time to react. The speed with which the baseball is traveling also means that the impact of the ball on the pitcher's head has the potential to cause grave injury. Many injuries, serious or otherwise, including injuries to the skull and face, have been caused by baseball strikes to the head.

Head protection is available for all baseball players and coaches but is rarely used due to reasons including lack of comfort, a perceived lack of need, customs and tradition, or a lack of desire to be burdened by a large, heavy helmet. Position players, pitchers and coaches are on the field for longer amount of time than batters, which may also contribute to the players and coaches foregoing use of protective headwear. Serious injuries to pitchers, players and coaches have resulted in public outcry but are generally too uncommon for preventative measures to be adopted by every pitcher, player and coach.

Therefore, it would be beneficial to provide protective headwear that overcomes past problems, and provides protection, comfort, ease of use, unobtrusiveness, and conforms to traditions and habits, such that all players and coaches will be encouraged to use the protective headwear.

SUMMARY

A headwear product is therefore provided which is effective in reducing injuries, and is unobtrusive, comfortable and wearable. In a preferred embodiment, the headwear is in the form of a baseball hat that attempts to strike a balance in protecting baseball players and coaches from the most common injuries while also being accepted and worn, as a helmet which is not worn will offer no protection.

A preferred protective headwear is provided herein that generally comprises a high rigidity multi-part cage connected together via elastic strips. The protective headwear comprises a first shell half and a second shell half, coupled to each other by first and second elastic strips to form a protective cage shaped to surround a person's head when said protective cage is in a worn position; and a plurality of pads coupled to an inner surface of said protective cage, and positioned to contact strong areas on said person's head when said protective cage is in a worn position, said plurality of pads having a thickness and position to create a spacing between said cage and said person's head when said protective cage is in a worn position.

A protective headwear is also provided, comprising a first shell half and a second shell half, coupled to each other by first and front second strips to form a protective cage shaped to surround a person's head when said protective cage is in a worn position; a plurality of pads coupled to an inner surface of said protective cage, and positioned to contact strong areas on said person's head when said protective cage is in a worn position, said plurality of pads having a thickness and position to create a spacing between said cage and said person's head when said protective cage is in a worn position; and a baseball cap coupled to an outer surface of said cage.

Additional features and advantages will be apparent with reference to the material provided below.

BRIEF DESCRIPTION OF THE DRAWINGS

FIG. 7 is an illustration, in left side view, of the head of a wearer, including regions on the head which pads will be adjacent to.

FIG. 8 is an illustration, in right side view, of the head of a wearer, including regions on the head which pads will be adjacent to.

Reference will now be made to the drawings, in which similar elements in different drawings bear the same reference numerals.

DETAILED DESCRIPTION OF THE DRAWINGS

Figure 1:
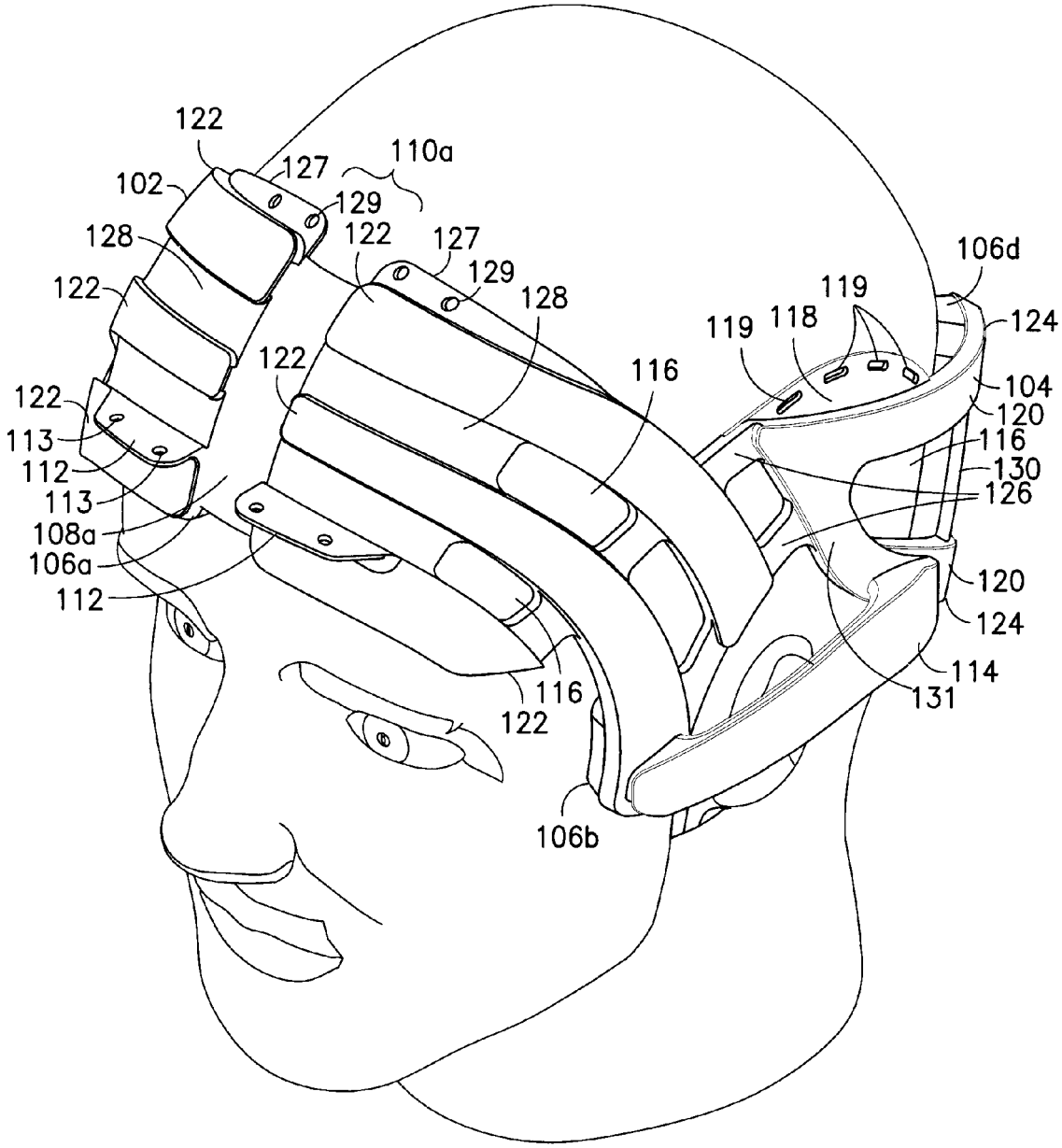
FIG. 1 is an illustration, in isometric view, of a protective headwear worn on a head.
Figure 2:
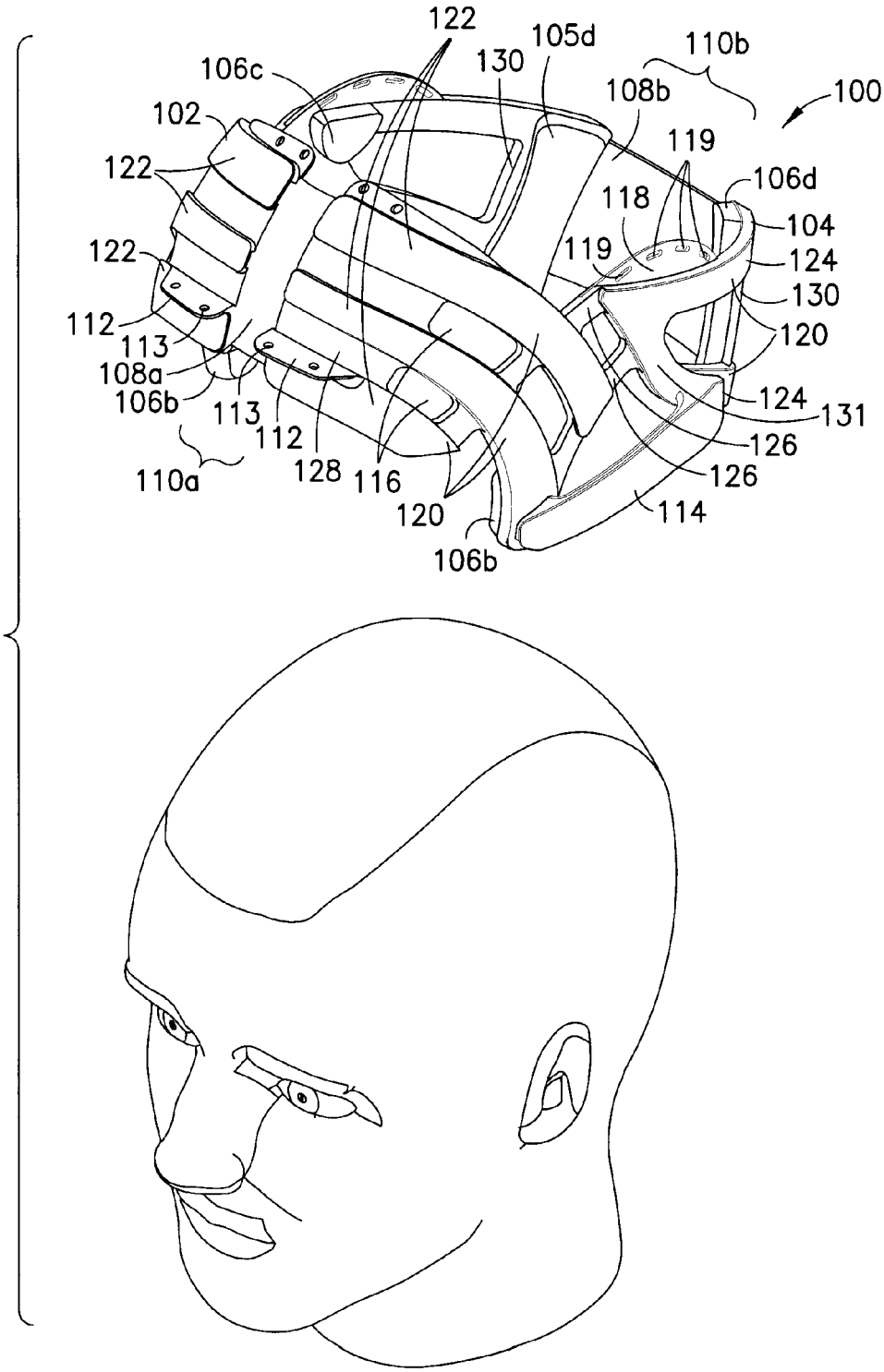
FIG. 2 is an illustration, in exploded isometric view, of a protective headwear and a head.

The drawings and following disclosure show and describe a protective headwear which may be attached to or incorporated into a hat, such as a baseball cap. Many specific details of the headwear are included to provide a thorough understanding of the headwear. One skilled in the art, however, will understand that the present disclosure may have additional embodiments, or that embodiments of the present disclosure may be practiced without several of the details according to the following description. For instance, while certain embodiments reference usage of specific materials, it will be appreciated by those of skill in the art that other materials may be used as needed or desired. The concepts of this disclosure may also be applied to other types of hats.

The design of the headwear takes into account many factors, including the locations of common injuries, and the nature of such injuries. Because of a person's general nature to turn or wince away from an object, such as a hard-hit baseball, as it approaches the head, the temporal lobe region of the skull is exposed to a direct hit. In many instances in which pitchers, players and coaches are hit in the head by a baseball, they have been struck in the temporal lobe region of the skull. This area is one of the most vulnerable areas to injury due to skull structure. The locations of these areas are taken into account in the design of the headwear.

Further, the nature of baseball strikes to the head is unique. When a baseball directly hits a helmet worn by a player, the ball is typically deflected away from that player, so the possibility of a second impact is remote. This allows the helmet to break, move, or fly off while remaining completely effective in mitigating the force of impact of the ball. When the helmet breaks, moves or flies off, a lot of the energy of the incoming ball is absorbed, thereby transferring less of the energy to the wearer of the helmet. These features are also taken into account in the design of the headwear.

Another issue is the issue of acceptance by baseball players. Protective headwear for use in the field must be: (i) sufficiently unobtrusive so that players and coaches will actually wear it (i.e., it should not interfere with the players' athletic motions, sight and hearing; (ii) comfortable, including good air circulation to prevent overheating; (iii) easy to use to accommodate the frequent and habitual action of putting on and taking off a baseball hat; and (iv) light weight.

The design of the headwear takes these features into consideration in a number of ways. For example, pads are provided which contact the wearer's skull at strong locations on the skull, while preventing contact with the wearer's skull at weaker skull locations during an impact. Additionally, the headwear is designed with a certain amount of flexibility, such that various parts of the headwear may absorb the energy of some of the impact. A split construction, pads and elastic layers assist with providing this functionality.

Further, to address acceptance of the headwear by baseball players and coaches, the headwear provided herein presents a solution that integrates a hat having a traditional, standard baseball cap shape with a protective headwear with minimum impact to the wearer in terms of comfort, flexibility, wearability and alteration of the pitcher's habits.

Figure 9:
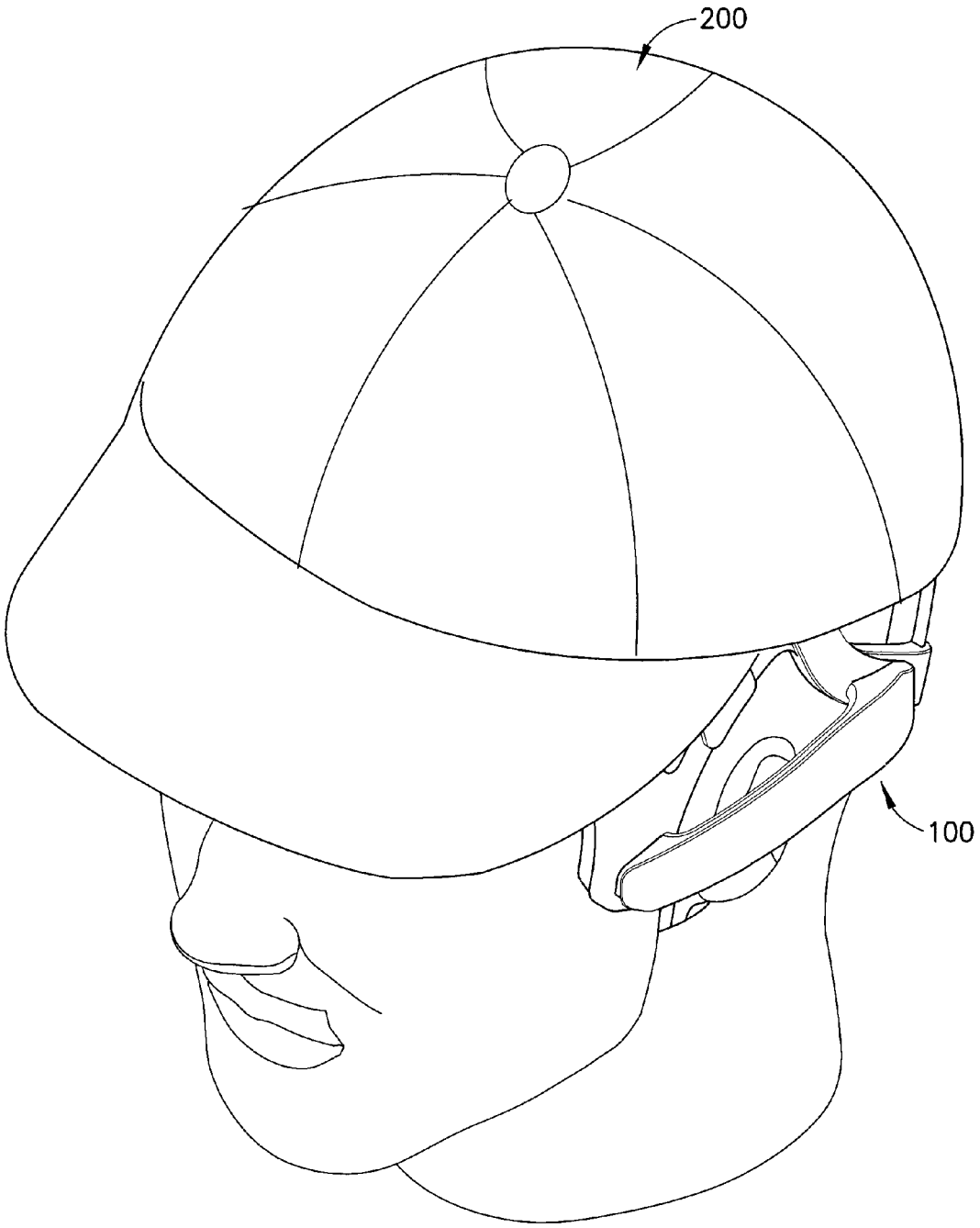
FIG. 9 is an illustration, in isometric view, of the protective headwear coupled to a traditional baseball style hat or cap.
Figure 10:
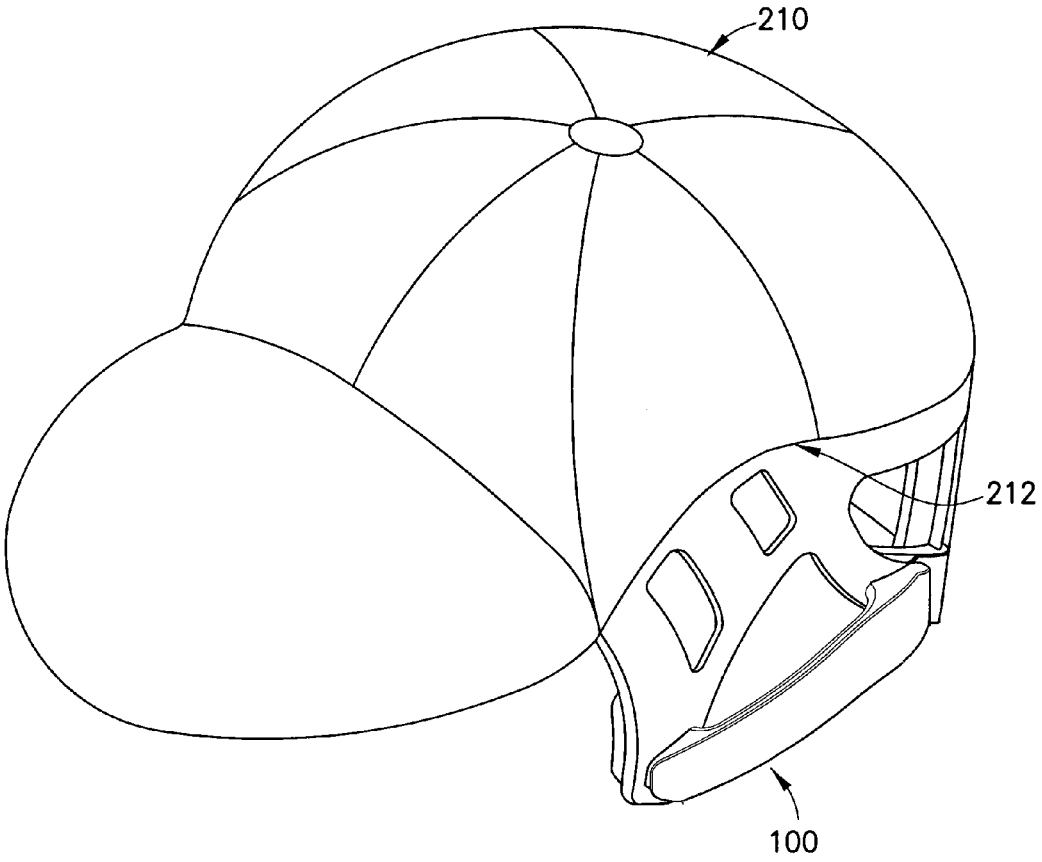
FIG. 10 is an illustration, in isometric view, of the protective headwear coupled to a custom baseball hat.

Generally, the headwear 100 comprises a hard shell in the form of a multi-part cage coupled to pads for contacting a wearer's head. The cage is divided into right and left shell halves 102, 104 connected together in the front and back via elastic strips for a more adjustable and comfortable fit. In an alternative embodiment, the shell halves may also be formed as front and back shell halves and connected together on the sides. The headwear will be discussed with consideration of FIGS. 1-6 taken together, which show only a hard interior shell, with the baseball cap portion left out for clarity. The cage operates to deflect impacts away from the temporal lobe region of a skull and direct the impact to stronger areas of the skull (described below with reference to FIGS. 7 and 8). To improve the economy of space and effectiveness of utility it is preferred that the cage is integrated into a hat as shown in FIGS. 9 and 10, described below.

Headwear 100 comprises two shell halves: a right shell half 102, and a left shell half 104, which are shaped to surround and fit snugly around a wearer's head, to provide a cap-like fit and to provide break-away or deflection properties. The shell halves 102, 104 are made of a rigid material, such as polycarbonate, which serves to provide the protective function. Vertical gaps 110*a* and 110*b* between the two shell halves 102, 104 are present and separate the right shell half 102 and left shell half 104 in a circumferential direction. Rear vertical gap 110*b* is wider than front vertical gap 110*a*. The width of rear vertical gap 110*b* is wider due to the expectation that it is less likely to be impacted by a ball in the rear than in the front, and therefore, less rigid material leads to less weight. However, the width of both gaps 110*b*, 110*a* may be altered to change properties of the headwear 100 such as weight, area of protection, deflection energy absorbed, and other properties. The gaps may also be formed in the sides between front and back shell halves.

Elastic strips 108*a* and 108*b* occupy the vertical gaps 110*a* and 110*b*. The two shell halves 102, 104 are connected together through the elastic materials 108*a*, 108*b*. 108*a* is a front elastic strip and 108*b* is a rear elastic strip. Gaps and elastic materials may be provided in different configurations. For example, gaps may be diagonal, rather than vertical gaps, may be curved, may have thickness variations, or may be shaped differently in other respects. The elastic strips provide for ease of use, comfort and adjustability. The elastic materials are coupled to both shell halves 102, 104 in both vertical gaps 110*a* and 110*b*. Alternatively, elastic strips may be provided with an adjustment feature to adjust the width of the gaps for additional comfort or sizing.

The elastic materials 108*a* and 108*b* are shaped as a vertical strip of elastic material, filling in the vertical gaps 110*a* and 110*b*. These elastic materials 108*a*, 108*b* serve a shock absorbing function when a ball hits the helmet by providing some degree of compressibility to an otherwise rigid helmet. The elastic materials 108*a*, 108*b* also serve a deflection function, by ensuring that some of the kinetic energy of an incoming ball is absorbed and the velocity of the outgoing ball is therefore reduced, which reduces the energy of the impact. The elastic materials 108*a*, 108*b* also serves the purpose of allowing the hat to slip on and off easily, by imparting a stretchiness to the overall structure of the hat. The elastic materials 108*a*, 108*b* also serve to absorb some of the energy of impact on the cage by an object such as a ball, by deforming, and thus absorbing some energy, when impacted. Preferred elastic materials should have long life and resistance to degrading from washing and exposure to the sun, and should be flexible but strong to resist impact, comfortable when against a wearer's head, and should not stretch out after repeated use.

The two shell halves 102, 104 are configured in the form of a cage comprising rails 120 running in a generally circumferential direction, which provide the rigidity and protection needed, and gaps 116 between the rails through which air may flow to allow for ventilation to a wearer's head.

In a preferred embodiment, a first set of rails 122 runs along the forehead region of the headwear 100, and curves down toward the jawbone region. One of the first set of rails 122, the one which is lowest on the wearer's head, does not fully extend downward to the jawbone region, but ends at a point above the wearer's eye. Front vertical rails 128 connect the first set of rails 122 in the front of the headwear 100. The front vertical rails 128 are thicker than the rails in the first set of rails 122 and may have a slight variation in thickness along their length. The thickness of the front vertical rails 128 allows transfer of a large amount of force from an impacting ball, through pads contacting the wearer's forehead, to the wearer's forehead, which is a strong area of the skull.

A second set of rails 124 runs in a circumferential direction along the rear region of the headwear 100. This second set of rails 124 extends from a location approximately in the rear of the skull, to a location which is just above the ear, wrapping circumferentially around a rear portion of a wearer's head. Rear vertical rails 130 connect the second set of rails 124 in the rear of the headwear 100. Rear vertical rails 130 are thicker than the rails in the second set of rails 124, which serves to help shield the rear of the wearer's head from strikes by a ball or other object, and provides a location on which to attach pads 106*d*. As can be seen, especially in FIG. 3, internal surfaces of the rear vertical rails 130 are covered by pads 106*d* for contacting the wearer's head. Near the wearer's ear, a vertical connector 131 connects the rails of the second set of rails 124 together. As with the first set of rails, the second set of rails also define gaps 116 for ventilation of the wearer's head. The cage may be configured and shaped such that shell material is located in key places for protection, and gaps 116 exist to provide ventilation in spots which do not require hard shell material for wearer protection. Alternatively, the gaps may simply be small enough to prevent an object such as a ball from directly impacting a wearer's head.

Temporal rails 126 extend along the temporal region of the headwear 100 and are connected to both the first set of rails 122 and the second set of rails 124. There are two temporal rails 126. The lower temporal rail connects to one of the rails in the first set of rails 122 at approximately the jawbone region. The overlap of the two rails at this location provides for a reinforcement area at which pad 106*b* is attached. The lower rail is also coupled to the upper two rails in the first set of rails 122. The upper temporal rail is coupled to and overlaps with all three rails in the first set of rails 122. There are gaps 116 that are defined by the intersections between the temporal rails 126 and the first set of rails 122.

The rails are all preferably made out of a rigid or semi rigid material that blocks a projectile from striking a wearer's head, such as a polycarbonate material. Although the shape of the cage is disclosed as having rails, which provides certain advantages, it should be understood that the structure of the cage can include any of a wide variety of configurations, including completely solid, completely solid with holes, a combination of rails in varying configurations, or other different configurations. Further, the disclosed cage/rail configuration may be modified by changing the position of the gaps 116, by varying the thickness of the cage in different locations, or in other ways. Any modifications to the cage that are made should by made taking into account two competing considerations: 1) the level of protection offered by the cage, which can be altered by changing the material of the cage and the thickness of the cage, among other things; and 2) the level of comfort and ventilation offered by features such as weight, ventilation holes (such as gaps 116), and other features.

Figure 3:
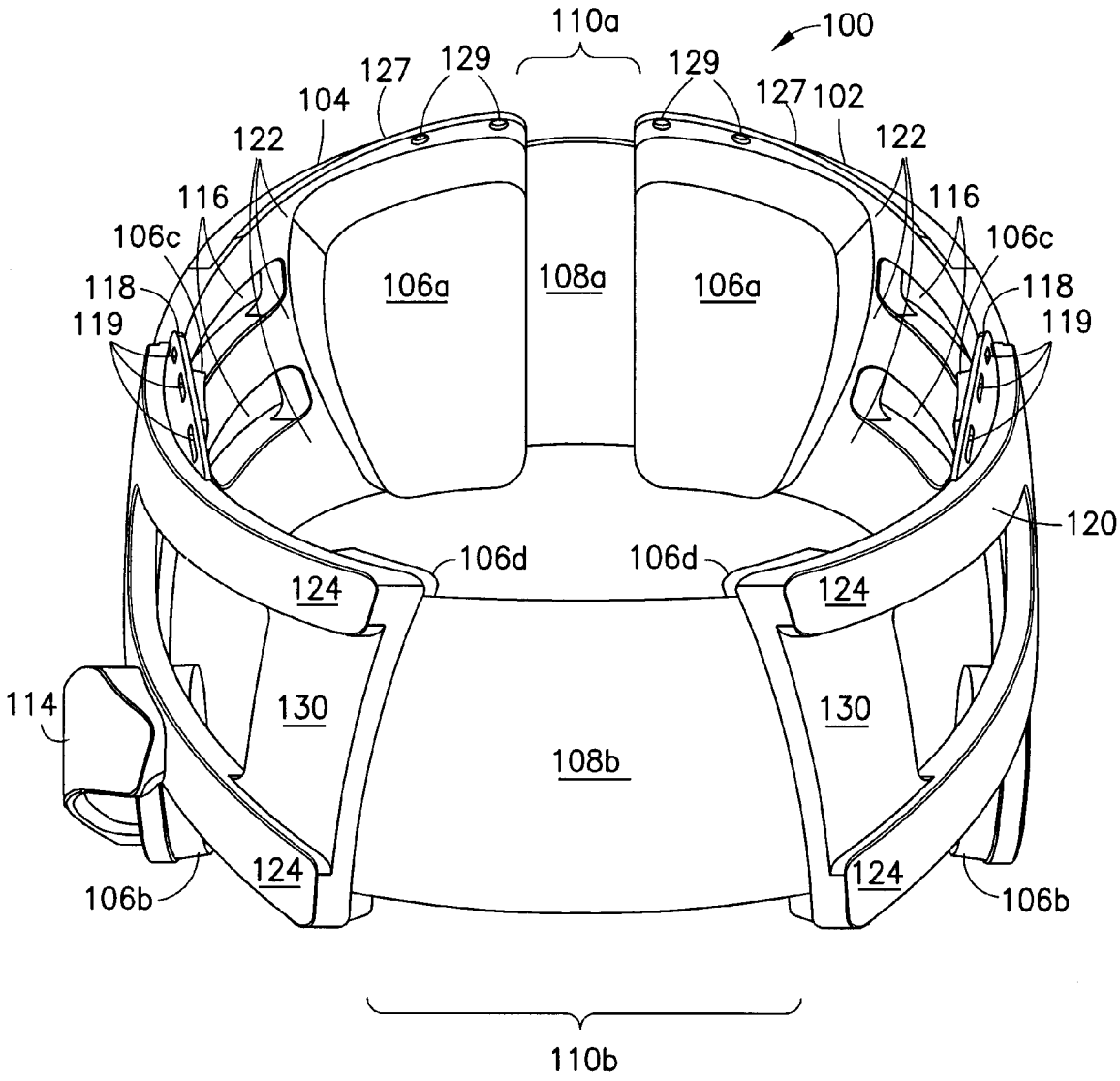
FIG. 3 is an illustration, in back side view, of a protective headwear.
Figure 4:
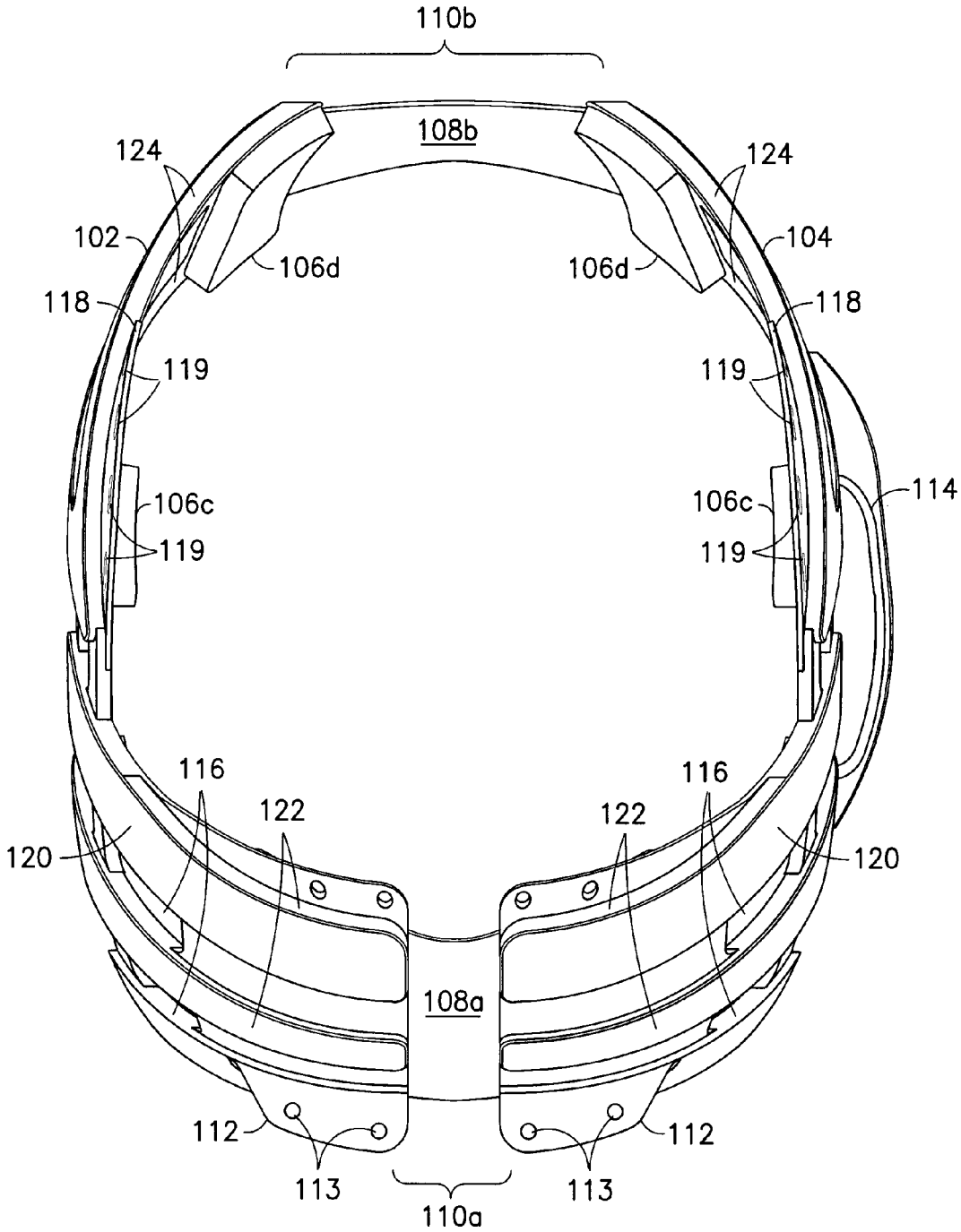
FIG. 4 is an illustration, in top side view, of a protective headwear.
Figure 5:
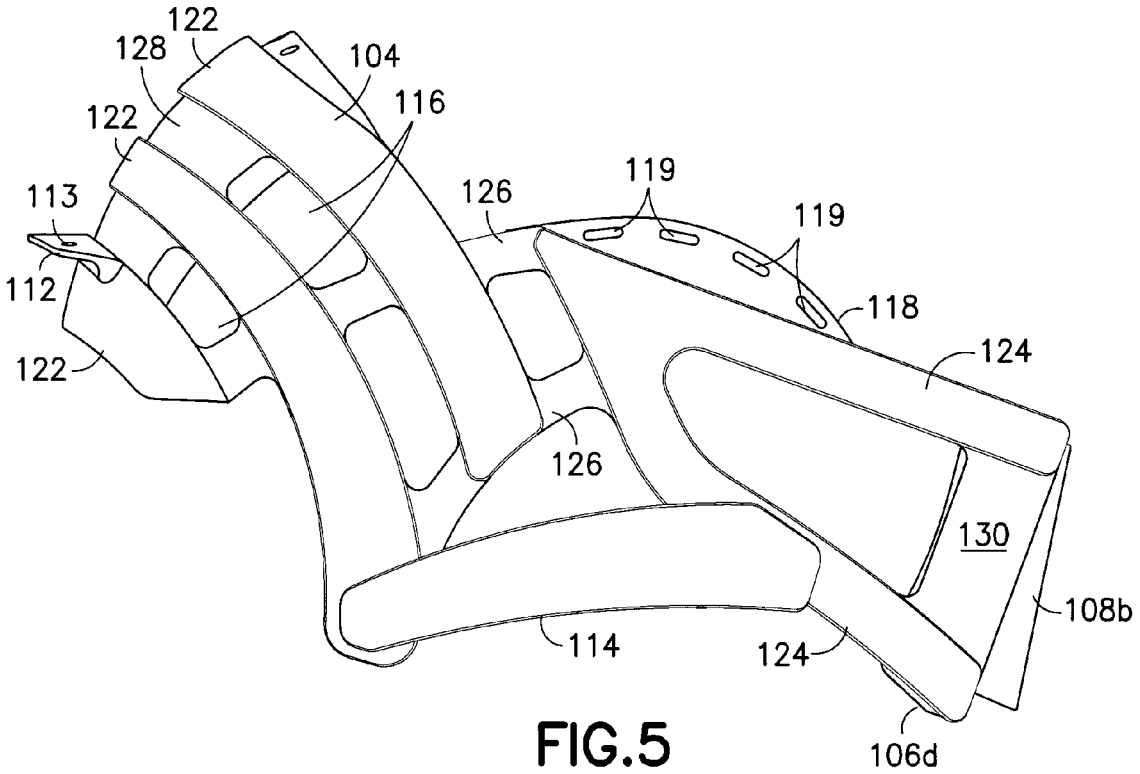
FIG. 5 is an illustration, in left side view, of a protective headwear.
Figure 6:
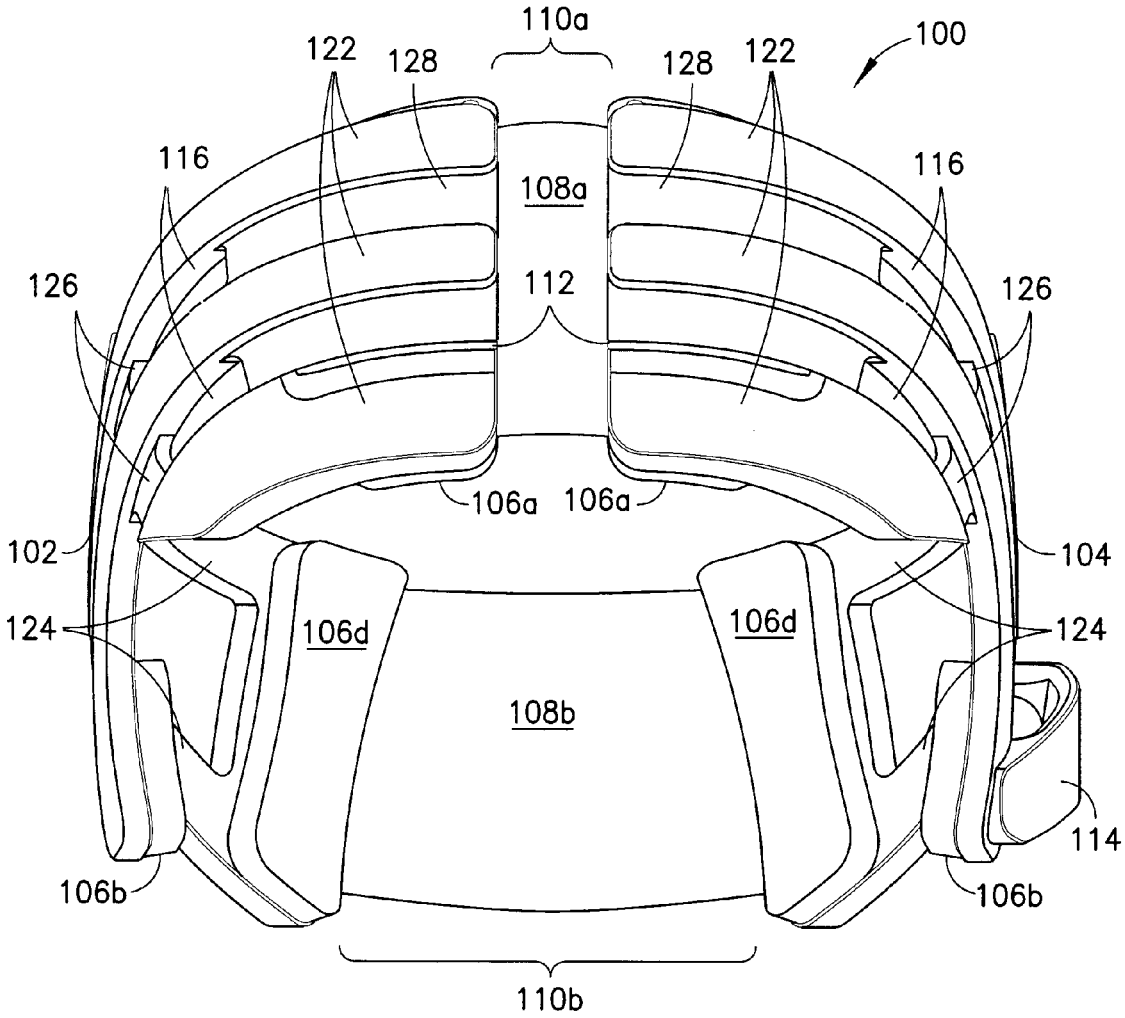
FIG. 6 is an illustration, in front side view, of a protective headwear.

Pads 106*a*, 106*b*, 106*c* and 106*d* are provided to redirect the impact force from the point at which the ball strikes the wearer's head, to other locations on the wearer's skull, which are naturally stronger (see FIGS. 7 and 8, described below). The structural rails float above and between the pads. Impact force on the rails is therefore diverted away from the more vulnerable temporal lobe area and toward the stronger areas of the skull. Pads may be made from a foam material or other material that provides sufficient cushioning to absorb a blow. Pads should provide a balance of stiffness for shock absorbency and flexibility for comfort. Pads may also be surrounded by a fabric for sweat absorption and comfort. Referring to FIGS. 3 and 4, pads include forehead located pads 106*a*, which are sufficiently large to absorb a direct impact from a baseball, as well as pads 106*b* located at the top of the jawbone, and pads 106*c* located above the ear. It should be noted that these are example locations and that location, shape and size of the pads may be adjusted as needed. Each of these pads is located at the intersection between two rails, which provides sufficient structural reinforcement at these key areas. It should be understood that pads may be adjusted in terms of size, location, number, and other factors, to provide the necessary weight, comfort, protection, ventilation, and to take into account other factors, as needed. Pads may be installed to be removable or not removable with an adhesive or other type of fastening device (such as VELCRO®) that permits ready removal and re-installation of the pads.

A stitching area 118 is provided for attachment of the headwear 100 to a baseball hat. FIG. 9 shows the headwear incorporated into a standard baseball hat 200. Note that several portions of the headwear 100 may be viewable even while the baseball hat is covering the majority of the headwear 100. In an alternative embodiment shown in FIG. 10, the headwear 100 may be incorporated into a customized baseball cap 210, which looks like a standard baseball hat, but has a cutaway portion 212 on the side of the hat in the region of the parietal/temporal bone of the wearer and in the rear portion of the hat. The cutaway portion 212 is in the shape of a top surface of the headwear 100 and removes a certain amount of material from the hat to provide a streamlined appearance, and remove excess bulk around the location of the ear of a wearer. The stitching area 118 is a small flat extension, extending upwards from the temporal region and the area of the pad 106*b* located at the top of the jawbone. Threads or strands of any desired material may be threaded through the holes 119 in the stitching area 118 and also sewn or otherwise attached to a baseball hat. For example, alternate methods of attachment of the headwear to the baseball hat include the use of rivets, stitching, glue or other methods.

A brim attachment area 112 is provided for attachment to the brim of a baseball hat. An upper hat attachment area 127 is also provided with holes 129 for attachment to an upper portion of a baseball hat. As with the stitching area 118, threads or strands of a desired material may be threaded through the holes 113, 129 of the brim attachment area 112 and upper hat attachment area 127 and attached to the baseball hat. Other methods of attachment may also be used, including those described above, such as using rivets, stitching, glue or other methods.

An ear guard 114 may be provided on one or both sides of the headwear 100 to protect the ear from a side impact. The ear guard 114 is preferably made of a rigid material, similarly to the rails of the cage. The ear guard 114 may also be detachable, and may be coupled to the rest of the headwear 100 through the use of a snap on mechanical feature, Velcro, or through other means.

Figure 8:
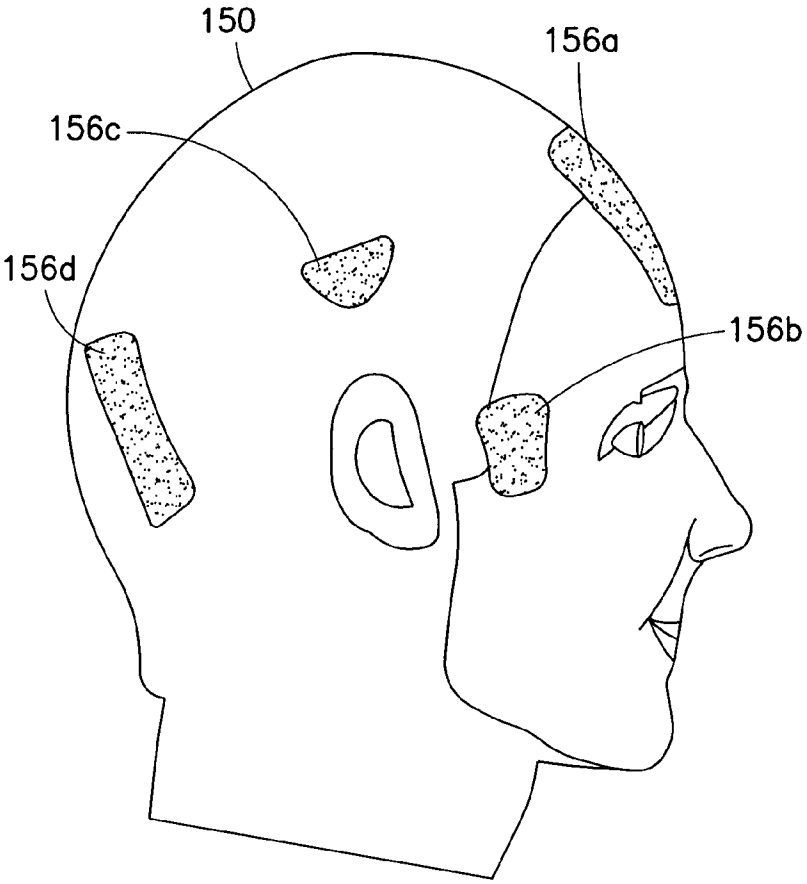
Figure 7:
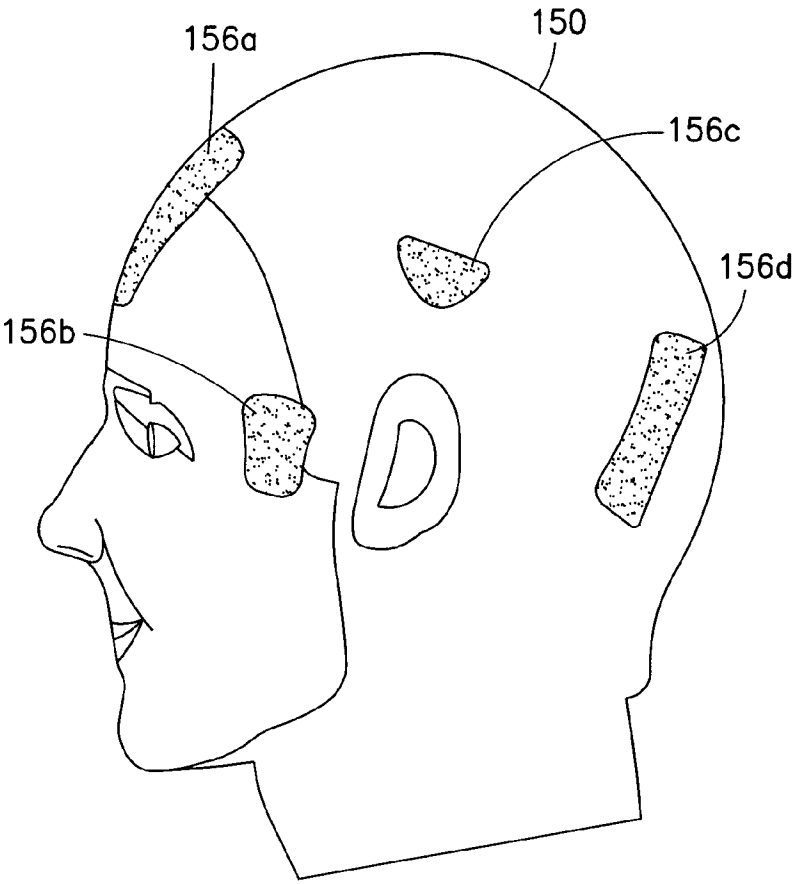

FIGS. 7 and 8 depict a human skull. The human skull is not uniformly strong throughout. There are weaker areas, as well as stronger areas. Some of the stronger areas are depicted in FIGS. 7 and 8. These areas include forehead areas 156*a*, the top of the jawbone 156*b* (approximately in the area of the zygomatic bone), an area above the ear 156*c* (a lower portion of the parietal bone) and rear areas 156*d* (a rear portion of the parietal bone or the occipital bone). When the disclosed headwear 100 is in a worn position on the wearer's head, the pads described above 106*a*, 106*b*, 106*c* and 106*d* are placed adjacent to the hat wearer's head 150 at the corresponding stronger areas 156*a*, 156*b*, 156*c* and 156*d*. The rigid cage and location of these pads helps to distribute the force of a blow from an oncoming object, such as a baseball, from weaker areas of the skull to the stronger areas 156*a*, 156*b*, 156*c* and 156*d* of the skull 150.

While the disclosure has been described with reference to various embodiments, it will be understood by those skilled in the art that various changes may be made and equivalents may be substituted for elements thereof without departing from the scope of the disclosure. In addition, many modifications may be made to adapt a particular situation to the teachings of the disclosure without departing from the essential scope thereof, for example, the materials of the headwear may be modified to balance weight, cost and mechanical properties; the shapes of the headwear may be modified based on additional testing; the interface between the protective headwear and the standard baseball cap may be altered. It is intended that the disclosure not be limited to the particular embodiment disclosed herein contemplated for carrying out the disclosure, but that the disclosure will include configurations, modifications or combinations falling within the scope of the appended claims.

We claim:

1. A protective headwear for non-intrusive integration with a non-protective headwear, comprising:

a first shell half and a second shell half each comprising a plurality of rails positioned in a generally circumferential direction between a first vertical rail and a second vertical rail, the first shell half and the second shell half coupled to each other by a first stretchable material and a second stretchable material, the first stretchable material positioned in a first gap formed between a first end of the first shell half and a first end of the second shell half, the second stretchable material positioned in a second gap formed between a second end of the first shell half and a second end of the second shell half, and integrated with the non-protective headwear to form a protective cage adapted to circumferentially surround a person's head when the non-protective headwear is placed in a worn position on the person's head; and a plurality of pads coupled to an inner surface of said protective cage, and adapted to contact a plurality of strong areas on the person's head when said protective cage is in the worn position.

2. The protective headwear of claim 1, wherein said first shell half and said second shell half each comprise gaps for ventilation and for weight reduction.

3. The protective headwear of claim 1, wherein:

said strong areas on the person's head comprise a forehead area, a zygomatic bone area at the top of the person's jawbone, an area in a lower portion of the person's parietal bone above the person's ear and an area in the rear of the person's head.

4. The protective headwear of claim 3, wherein each of said first shell half and said second shell half comprises:

a first set of rails having a first shape and a first position adapted to make contact with the forehead area through a first pad in the plurality of pads and with the zygomatic bone in the person's head through a second pad in the plurality of pads;

a second set of rails having a second shape and a second position adapted to make contact with the area in the rear of the person's head through a third pad in the plurality of pads; and a third set of rails having a third shape and a third position adapted to make contact with the zygomatic bone through the second pad and the lower portion of the person's parietal bone above the ear through a fourth pad in the plurality of pads.

5. The protective headwear of claim 4, wherein:

each of said first set of rails, said second set of rails and said third set of rails define gaps in said first shell half and said second shell half.

6. The protective headwear of claim 4, wherein:

the non-protective headwear is a baseball cap having a hat portion adapted to cover the person's head and a brim portion extending forward from the hat portion.

7. The protective headwear of claim 6, wherein:

the third set of rails comprises a hat attachment area for attaching the hat portion of the baseball cap to the protective cage, and the first set of rails comprises a brim attachment area for attaching the brim portion of the baseball cap to the protective cage.

8. The protective headwear of claim 4, wherein:

a first end of said first set of rails is connected to the first vertical rail in a front overlap area of the protective cage adapted to be positioned at the forehead area;

a second end of said first set of rails is connected to said third set of rails in a jawbone overlap area of the protective cage adapted to be positioned at the zygomatic bone area at the top of the person's jawbone;

said third set of rails is connected to said second set of rails in a temporal overlap area of the protective cage adapted to be positioned in a temporal region; and said second set of rails is connected to the second vertical rail in a rear overlap area of the protective cage adapted to be positioned in the rear of the person's head.

9. The protective headwear of claim 4, further comprising:

an ear guard coupled to a second end of one of the first set of rails and to the second set of rails at a side of said protective cage.

10. The protective headwear of claim 1, wherein the protective cage extends below a lower end of the non-protective headwear.

11. The protective headwear of claim 1, wherein the second gap has a width that is larger than a width of the first gap.

12. The protective headwear of claim 1, wherein the first stretchable material fills the first gap and the second stretchable material fills the second gap.

13. A non-protective baseball cap with a non-intrusive integrated protective headwear, comprising:

a first shell half and a second shell half each comprising a plurality of rails positioned in a generally circumferential direction between a first vertical rail and a second vertical rail, the first shell half and the second shell half coupled to each other by a first stretchable material and a second stretchable material, the first stretchable material positioned in a first gap formed between a first end of the first shell half and a first end of the second shell half, the second stretchable material positioned in a second gap formed between a second end of the first shell half and a second end of the second shell half, and integrated with the non-protective baseball cap to form a protective cage adapted to circumferentially surround a person's head when the non-protective baseball cap is placed in a worn position on the person's head; and a plurality of pads coupled to an inner surface of said protective cage, and adapted to contact a plurality of strong areas on the person's head when said protective cage is in the worn position.

14. The protective headwear of claim 13, wherein:

said strong areas on said person's head comprise a forehead area, a zygomatic bone area at the top of the person's jawbone, an area in a lower portion of the person's parietal bone above the person's ear, and an area in the rear of the person's head.

15. The baseball cap of claim 14, wherein each of said first shell half and said second shell half comprises:

a first set of rails having a first shape and a first position adapted to make contact with the forehead area through a first pad in the plurality of pads and with the zygomatic bone area in the person's head through a second pad in the plurality of pads;

a second set of rails having a second shape and a second position adapted to make contact with the area in the rear of the person's head through a third pad in the plurality of pads; and a third set of rails having a third shape and a third position adapted to make contact with the zygomatic bone area through the second pad and the lower portion of the person's parietal bone above the ear through a fourth pad in the plurality of pads.

16. The baseball cap of claim 15, further comprising:

an ear guard coupled to a second end of one of the first set of rails and to the second set of rails at a side of said protective cage.

17. The baseball cap of claim 15, wherein:

a first end of said first set of rails is connected to the first vertical rail in a front overlap area of the protective cage adapted to be positioned at the forehead area;

a second end of said first set of rails is connected to said third set of rails in a jawbone overlap area of the protective cage adapted to be positioned at the zygomatic bone area at the top of the person's jawbone;

said third set of rails is connected to said second set of rails in a temporal overlap area of the protective cage adapted to be positioned in a temporal region of the person's head; and said second set of rails is connected to the second vertical rail in a rear overlap area of the protective cage adapted to be positioned in the rear of the person's head.

18. The baseball cap of claim 15, wherein:

the third set of rails comprises a hat attachment area for attaching a hat portion of the baseball cap to the protective cage, and the first set of rails comprises a brim attachment area for attaching a brim portion of the baseball cap to the protective cage.

19. The baseball cap of claim 15, wherein:

each of said first set of rails, said second set of rails and said third set of rails define gaps in the first shell half and the second shell half.

20. The baseball cap of claim 13, wherein the second gap has a width that is larger than a width of the first gap.

* * * * *